US006811818B2

(12) United States Patent
Herwig et al.

(10) Patent No.: US 6,811,818 B2
(45) Date of Patent: Nov. 2, 2004

(54) METHOD AND DEVICE FOR PAINTING MOTOR VEHICLE BODIES

(75) Inventors: Gernot Herwig, Holzgerlingen (DE); Wolf-Hasso Schaefer, Tiefenbronn-Mühlhausen (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 09/959,219

(22) PCT Filed: Jan. 30, 2001

(86) PCT No.: PCT/EP01/00963

§ 371 (c)(1),
(2), (4) Date: Jan. 17, 2002

(87) PCT Pub. No.: WO01/60528

PCT Pub. Date: Aug. 23, 2001

(65) Prior Publication Data

US 2002/0160110 A1 Oct. 31, 2002

(30) Foreign Application Priority Data

Feb. 16, 2000 (DE) ..... 100 06 865

(51) Int. Cl.[7] ..... B05D 3/00

(52) U.S. Cl. ..... 427/299; 118/320; 118/500; 427/327; 427/425; 427/427

(58) Field of Search ..... 427/299, 327, 427/425, 427; 118/320, 500

(56) References Cited

U.S. PATENT DOCUMENTS

| | | | | |
|---|---|---|---|---|
| 2,597,914 | A | 5/1952 | Whitworth et al. | 118/502 |
| 2,729,189 | A | 1/1956 | Schweitzer et al. | 118/6 |
| 2,952,351 | A | 9/1960 | Stone | 198/177 |
| 5,674,570 | A | 10/1997 | Fouvet | 427/421 |

FOREIGN PATENT DOCUMENTS

| | | |
|---|---|---|
| DE | 90 04 814.8 | 9/1990 |
| DE | 44 04 422 | 9/1994 |
| DE | 690 09 336 | 9/1994 |
| DE | 197 26 349 | 1/1999 |

*Primary Examiner*—Bernard Pianalto
(74) *Attorney, Agent, or Firm*—Factor & Lake

(57) ABSTRACT

A process and apparatus for painting vehicle bodies in which the bodies are moved past at least one paint-applying application device with the aid of a conveyor system, said application device for its part being guided by an application machine, and in which faces of the vehicle body which have different inclinations are painted.

7 Claims, 3 Drawing Sheets

METHOD AND DEVICE FOR PAINTING MOTOR VEHICLE BODIES

Figure 1:
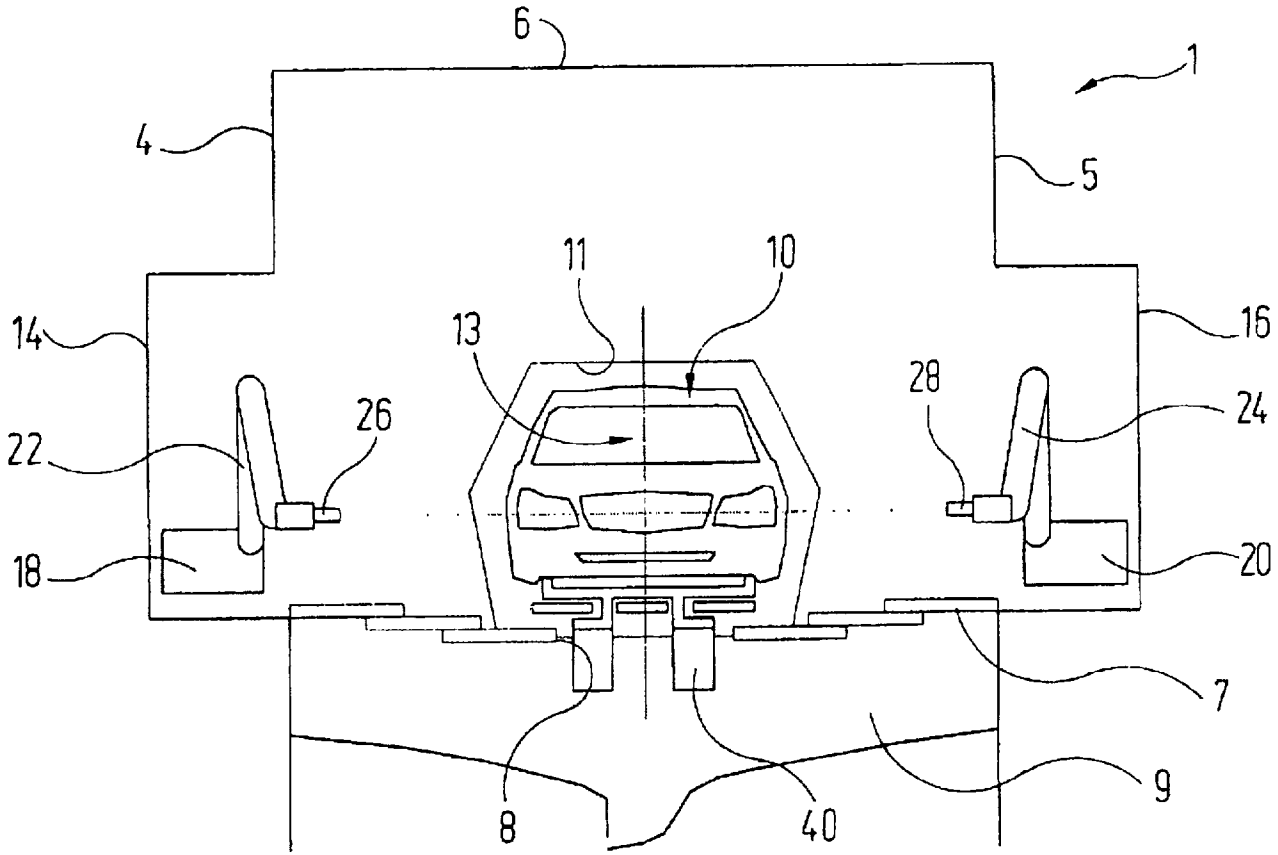

The invention relates to a process for painting vehicle bodies, in which these are moved past at least one paint-applying application device with the aid of a conveyor system, said application device for its part being guided by an application machine, and in which faces of the vehicle body which have different inclinations are painted, and a device for painting vehicle bodies having a) a conveyor system for the vehicle bodies;

b) at least one paint-applying application device, past which the vehicle bodies are moved by means of the conveyor system;

c) at least one application machine, by means of which the application device may be guided.

It is known that vehicle bodies have faces which need painting and which, in their "normal position" as assumed when the motor vehicle is fully assembled, have very different inclinations in relation to the horizontal. Thus, for example, large areas of the roof, the engine bonnet and the boot lid are often almost horizontally aligned faces, whilst the side parts, in particular the doors, extend almost vertically. To enable all these faces to be painted in one continuous process, a plurality of paint-applying application devices have hitherto been used at different points within the paint booth, and these are guided by means of different application machines.

Thus, there are generally one or more application devices which are guided above the vehicle bodies by means of suitable application machines, said vehicle bodies for their part being transported in the "normal position" through the paint booth. The substantially horizontal faces of the vehicle body are then painted with the aid of these upper application devices. Further application devices are provided laterally in relation to the movement path of the vehicle bodies, and apply paint to the lateral, more vertically inclined faces. Here, the application machines which guide the upper and the lateral application devices necessarily have different constructions.

This known painting process and known painting device is disadvantageous in that the upper application devices have to be guided by application machines which extend over the body to be painted. When the application machine moves, it can free dirt which deposits on the vehicle body to be painted and thus impairs the painting results. It is, moreover, relatively expensive to provide different application machines for the different application devices.

The object of the present invention is to provide a process for painting vehicle bodies of the type mentioned at the outset, by means of which the painting results can be improved with relatively little expenditure.

This object is achieved according to the invention in that, for the purpose of painting faces having different inclinations, the vehicle bodies are rotated about an axis and are thus moved past the same type of application device and the same type of application machine in different angular orientations.

Therefore, according to the invention, the vehicle bodies to be painted are rotated about an axis such that their normally upward-facing, more or less horizontally aligned faces can now be reached by a, for example, laterally arranged application device. Therefore, the application machine on which this application device is guided no longer needs to extend over the vehicle body to be painted. Dirt which may drop off the application machine can no longer deposit on the vehicle body. Moreover, it is only necessary to use one type of application machine, which is of great advantage both in manufacturing terms and also with regard to maintenance.

The vehicle bodies are advantageously guided past the same application device a plurality of times, an angular rotation of the vehicle bodies being effected at one or more reversal points in the movement. With this type of process, the length of the paint booth can be reduced considerably, resulting in huge cost reductions. Moreover, the same application devices and application machines can be used for each "passing-through" of the vehicle bodies in different angular positions, which likewise reduces investment costs.

The axis about which the vehicle bodies are rotated is advantageously their longitudinal axis.

The object of the present invention is furthermore to provide a device of the type mentioned at the outset, by means of which the painting results can be improved with relatively little expenditure.

This object is achieved in that d) the conveyor system has at least one rotating device in which the vehicle bodies are held such that they may be rotated in each case about an axis.

Advantageous further developments of the device according to the invention are revealed in Claims 5 and 6. The advantages of the device according to the invention and of the advantageous embodiments thereof correspond essentially to the advantages of the process according to the invention which have already been mentioned above.

BRIEF DESCRIPTION OF THE REFERENCES

Figure 2:
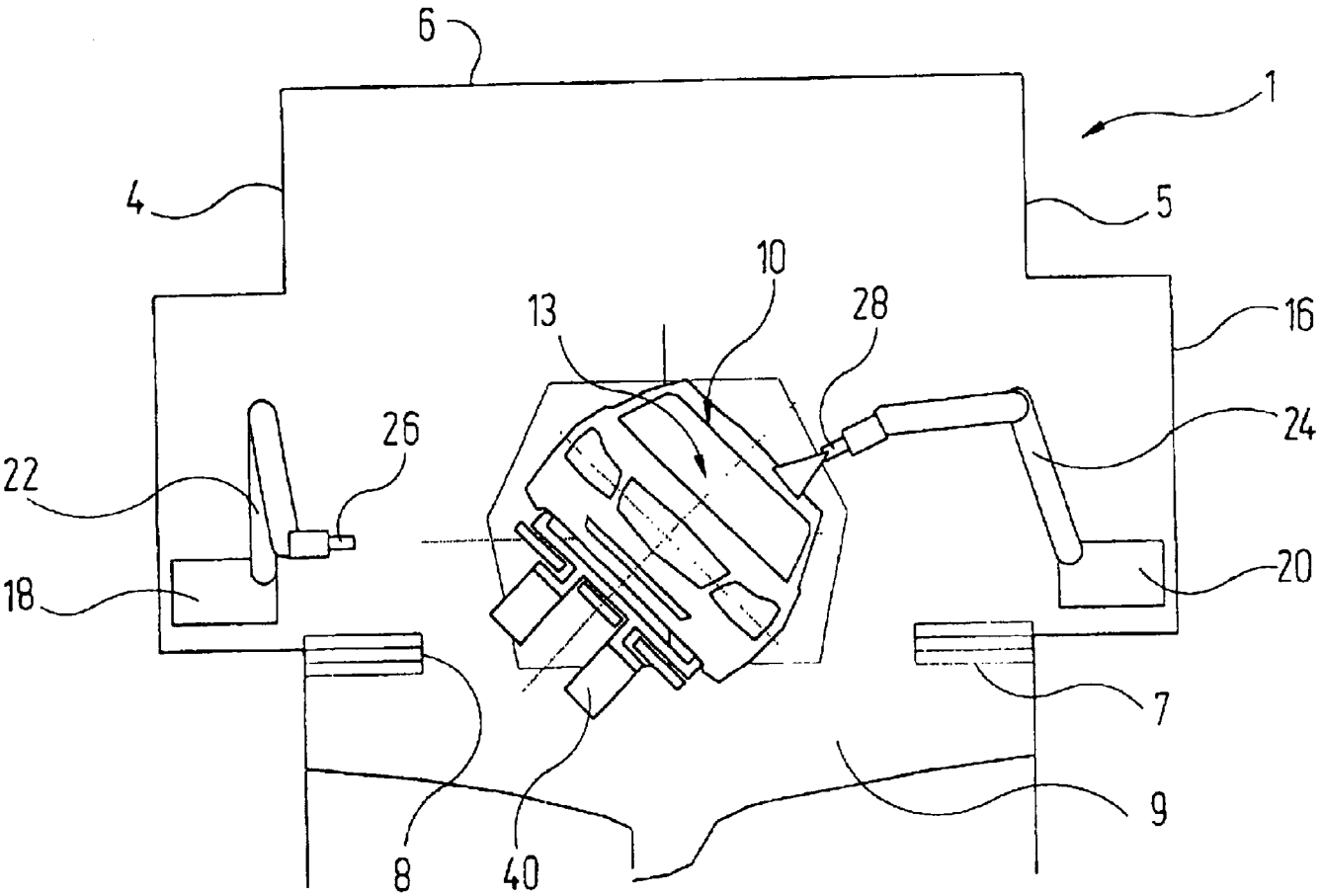
Figure 3:
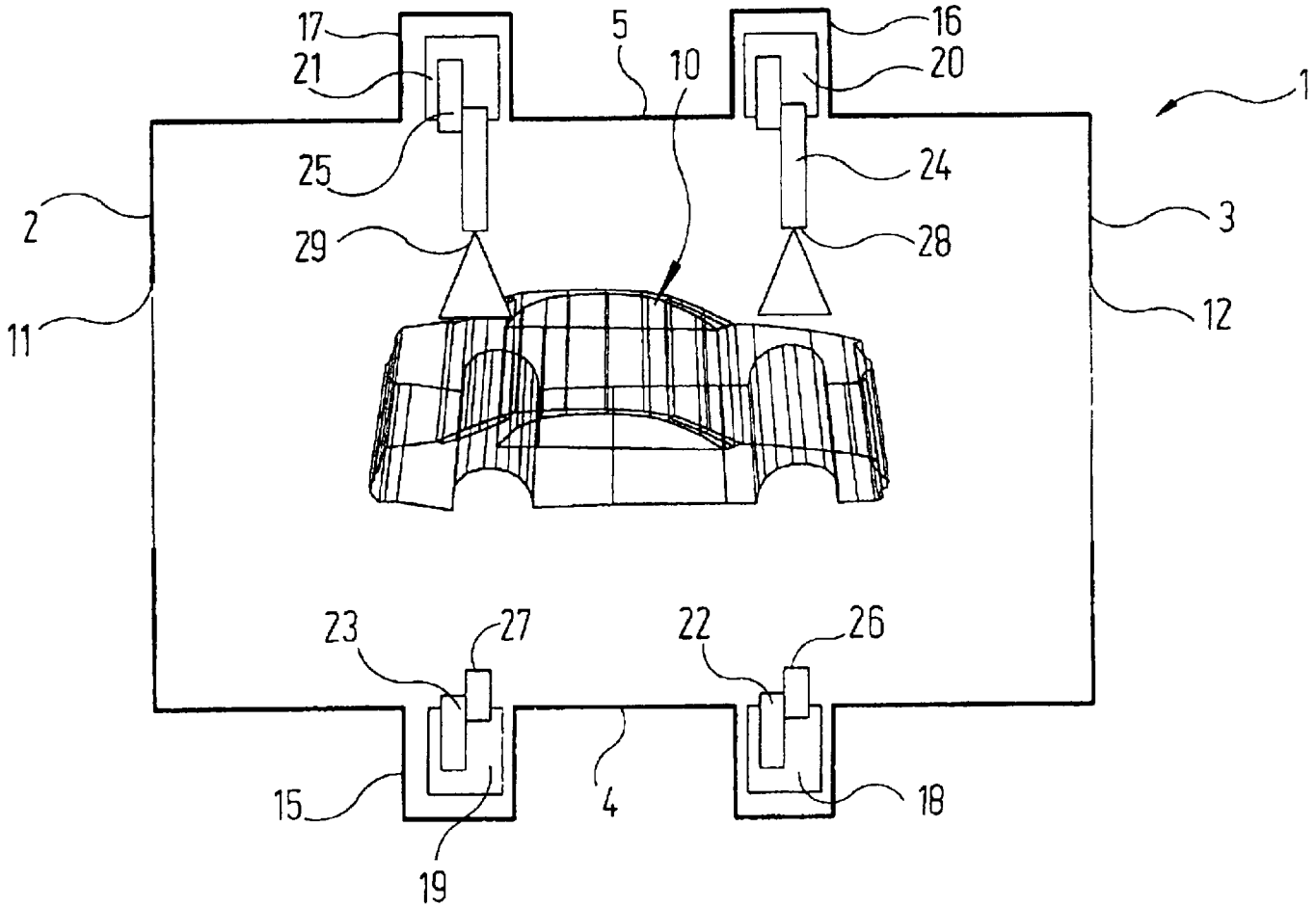

An exemplary embodiment of the invention is explained in more detail below, with reference to the drawing in which is shown:

FIG. 1 a vertical section perpendicular to the direction of movement of the vehicle bodies through a paint booth;

FIG. 2 a section similar to FIG. 1, but in which the vehicle body illustrated is tilted through approximately 45° in relation to its longitudinal axis;

FIG. 3 a schematic plan view of the paint booth of FIG. 2, with the booth roof removed.

The paint booth (illustrated in FIG. 1) for vehicle bodies is of a largely conventional construction. Its interior is delimited laterally by two end faces 2, 3 and two side walls 4, 5 (c.f. FIG. 3), at the top by a ventilating roof 6 and at the bottom by a floor 7 formed by grids which may be pushed one over another. An opening 8 in the floor 7 receives the lower components of a conveyor system 40 which, as such, is known and is only indicated schematically in the drawing.

By way of the grids of the floor 7, the interior of the paint booth 1 communicates with a rinse-out means 9 for paint over-spray, which, as such, is likewise known and is only illustrated in part.

The bodies 10 to be painted are guided through the paint booth 1—more precisely from an entry opening 11 in the one end face 2 to an exit opening 12 in the other end face 3—on the conveyor system 40. The conveyor system 40 only carries the bodies 10 indirectly by way of rotating devices 13, one of which is indicated schematically in the drawing. These enable the bodies 10 to be rotated about their longitudinal axis individually or in groups.

Application machines 18, 19, 20, 21 are accommodated in recesses 14, 15, 16, 17 in the side walls. Each application machine 18, 19, 20, 21 has a controllable articulated arm 22, 23, 24, 25, the actual paint-application device 26, 27, 28, 29, for example a paint spray gun, being mounted on the free end of said arm, which may be guided inside the paint booth 1. By means of the associated articulated arms 22, 23, 24, 25, the paint-application devices 26, 27, 28, 29 can be moved to and fro both in the direction of the central plane of the paint booth 1 and in the vertical direction. It is additionally possible to alter the inclination of the paint-application devices 26, 27, 28, 29 in relation to the horizontal and therefore the angle at which the directed spray strikes the faces to be painted.

In the paint booth 1 described, the vehicle bodies 10 are painted in the manner below:

Firstly, in the "normal position" in which their underside extends substantially horizontally, the vehicle bodies 10 enter inside the paint booth 1 by way of the entry opening 11. This is illustrated in FIG. 1. This Figure also shows the grids of the floor 7 pushed totally inwards, so that the operating personnel are still able to tread on the floor 7 within close proximity to the conveyor system 40. Then, the grids of the floor 7 are drawn back, as illustrated in FIG. 2. This improves the communication between the interior of the paint booth 1 and the rinse-out means 9 and reduces the risk of the grids becoming dirty. By means of the rotating device 13, the vehicle bodies 10 are now rotated clockwise, as viewed according to FIG. 1, through an angle of approximately 45° about their longitudinal axis, and thus reach the position illustrated in FIG. 2, in which the paint-application devices 28, 29 illustrated on the right-hand side of FIGS. 1 and 2 are at least able to reach the right half of the roof and also the upper right-hand side region of the bodies 10. The bodies 10 are conveyed further in this inclined position, the body regions mentioned being painted in a sinusoidal, partially overlapping track with the aid of the paint-application devices 28, 29. This sinusoidal, partially overlapping track is produced in that the linear movement of the vehicle bodies 10 coincides with an upward and downward movement of the application devices 28, 29. During this to and fro movement, these latter are moved towards and away from each painted face region with the aid of the articulated arms 24 and 25, thus maintaining a constant spacing between the paint-application device 28, 29 and the corresponding face region. At the same time, the angle of inclination of the paint-application device 28 in relation to the horizontal is adjusted such that the angle at which the directed spray strikes each painted face region is approximately constant.

If the vehicle body 10 is painted over the entire length of the said face regions, it is rotated through 90° anti-clockwise with the aid of the rotating device 13, that is to say it is rotated counter-clockwise as viewed according to FIGS. 1 and 2, so that it now reaches a position which is mirror-symmetrical with respect to the central plane of the paint booth in relation to the position illustrated in FIG. 2. In this rotated position, those paint-application devices 26, 27 which are on the left-hand side in FIGS. 1 and 2 can reach the left half of the roof and also the upper left-hand side regions of the vehicle body 10. The vehicle body 10 is now moved back again within the paint booth 1 with the aid of the conveyor system, during which the appropriate surface regions of the vehicle body 10 are painted.

If the vehicle body 10 has thus reached the entry region of the paint booth 1 again, it is rotated back into its neutral, "normal position" illustrated in FIG. 1, with the aid of the rotating device 13.

The direction of movement of the conveyor system is reversed so that the vehicle body 10 now moves forwards again out of the plane of projection in FIG. 1. Now, the hitherto still unpainted lower side regions of the vehicle body 10 are painted on both opposing sides by the paint-application devices 26, 27, 28, 29. By means of the conveyor system, the now fully painted vehicle body 10 is guided out of the paint booth 1 by way of the exit opening 12 and is supplied to further processing stations.

What is claimed is:

1. A process for painting vehicle bodies having a plurality of faces, comprising the steps of:

rotating the vehicle body into a first angular position about an axis at or near the dead center of movement of the vehicle body;

moving the vehicle bodies in a first direction while in the first angular position past at least one paint-applying application device with the aid of a conveyor system, whereby the application device is guided by an application machine and the faces of the vehicle bodies have different inclinations;

applying paint to the vehicle body with the application device during the step of moving the vehicle bodies in a first direction;

stepwise rotating the vehicle bodies about the axis to a second angular position;

moving the vehicle bodies in a second direction while in the second angular position past at least one paint-applying application device with the aid of the conveyor system; and applying paint to the vehicle body with the application device during the step of moving the vehicle bodies in a second direction;

thus moving the vehicle bodies and the faces thereof past the application device and the application machine in various angular orientations.

2. A process according to claim 1, wherein:

the step of rotating occurring at at least one reversal point in the movement.

3. A process according to claim 1, wherein the first and second steps of stepwise rotating occur about the longitudinal axis of the vehicle.

4. The process according to claim 1, wherein at least one of the steps is repeated until paint application is complete.

5. A device for painting vehicle bodies comprising:

a) a conveyor system having at least one rotating device upon which a vehicle is capable of being mounted, the at least one rotating device capable of stepwise rotating about an axis at or near the dead center of the movement of the vehicle bodies to at least a first angular position;

b) at least one paint-applying application device, positioned relative to the conveyor system such that vehicle bodies can be moved past the at least one paint-application application device while maintained in the particular angular position; and c) at least one application machine which is capable of guiding the at least one paint-applying application device.

6. A device according to claim 5, wherein the conveyor system is capable of traveling in a first direction, and in an opposite second direction; and wherein the at least one rotating device is capable of rotation upon reversal of the conveyor system from the first direction to the second direction.

7. A device according to claim 5, wherein the axis about which the vehicle bodies may be rotated is their longitudinal axis.

* * * * *